US007876060B2

(12) United States Patent
Alexandrov

(10) Patent No.: US 7,876,060 B2
(45) Date of Patent: Jan. 25, 2011

(54) MULTI-LAMPS INSTANT START ELECTRONIC BALLAST

(75) Inventor: Felix I. Alexandrov, Bedford, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 223 days.

(21) Appl. No.: 12/136,562

(22) Filed: Jun. 10, 2008

(65) Prior Publication Data

US 2009/0302775 A1 Dec. 10, 2009

(51) Int. Cl.
*H05B 37/02* (2006.01)

(52) U.S. Cl. ..... 315/307; 315/224; 315/312

(58) Field of Classification Search ..... 315/224, 315/225, 247, 294, 297, 307–308, 312
See application file for complete search history.

(56) References Cited

U.S. PATENT DOCUMENTS

| | | | | |
|---|---|---|---|---|
| 5,357,174 | A * | 10/1994 | Nerone et al. | 315/224 |
| 5,363,020 | A * | 11/1994 | Chen et al. | 315/209 R |
| 6,191,079 | B1 | 2/2001 | Klima et al. | |
| 6,362,575 | B1 | 3/2002 | Chang et al. | |
| 6,515,881 | B2 * | 2/2003 | Chou et al. | 363/95 |
| 7,030,570 | B2 | 4/2006 | Alexandrov | |
| 7,045,966 | B2 | 5/2006 | Alexandrov | |
| 7,095,183 | B2 | 8/2006 | Alexandrov | |
| 7,352,139 | B2 | 4/2008 | Ribarich et al. | |
| 7,372,215 | B2 | 5/2008 | Sekine et al. | |
| 7,622,870 | B2 * | 11/2009 | Fukumoto et al. | 315/291 |
| 2005/0184685 | A1 | 8/2005 | Sekine et al. | |
| 2006/0186834 | A1 * | 8/2006 | Ribarich et al. | 315/312 |
| 2007/0176564 | A1 | 8/2007 | Nerone et al. | |
| 2008/0122387 | A1 * | 5/2008 | Chien | 315/307 |
| 2008/0258640 | A1 * | 10/2008 | Masuda | 315/224 |
| 2009/0015172 | A1 * | 1/2009 | Huang et al. | 315/246 |

FOREIGN PATENT DOCUMENTS

| | | | |
|---|---|---|---|
| JP | 2001-351792 | A1 | 12/2001 |
| JP | 2002-015884 | A1 | 1/2002 |
| JP | 2006-222050 | A1 | 8/2006 |

* cited by examiner

*Primary Examiner*—Douglas W Owens
*Assistant Examiner*—Tung X Le
(74) *Attorney, Agent, or Firm*—Shaun P. Montana

(57) ABSTRACT

The electronic ballast comprises a series half bridge resonant inverter and a control circuit for the inverter with dimming capability. The inverter includes a first and a second voltage feedback circuits including first and a second charge pumps coupled in between inverter output and the dimming input of the control circuit. The feedback circuits generate a reference control signal to control operation after starting and an error control signals when the inverter output voltage exceeds a predetermined value.

18 Claims, 6 Drawing Sheets

MULTI-LAMPS INSTANT START ELECTRONIC BALLAST

FIELD OF THE INVENTION

The present invention relates to electronic ballasts, and more specifically, to series resonant ballast inverters for operating multiple discharge lamps. In addition, it relates to ballast starting and steady-state operation of a variable number of lamps (for instance, from 0 lamps to 4 lamps) to maintain a constant brightness level of the lamps.

BACKGROUND OF THE INVENTION

Gas discharge lamps utilize electronic ballasts for converting an AC line voltage into a high frequency current for powering the gas discharge lamps. Instant start ballasts typically supply power to several lamps in a fixture. The instant start ballast is frequently used for lamp starting without preheating the lamp filaments. For example, the industry standard, instant start electronic ballast for multiple T8 lamps employs a current fed parallel resonance inverter. Since this inverter is a voltage source rather than a current source, each of these lamps is connected to the inverter output via a boost capacitor. A difference between a current fed half bridge resonance inverter and a voltage fed series resonance half bridge inverter is that in the current fed inverter maximum voltage across switching transistors is more than twice as high as the voltage fed inverter. A half bridge current fed ballast inverter requires high voltage transistors (1100V and higher), whereas in a half bridge voltage fed series resonant inverter the maximum transistor voltage is much lower, i.e., it is equal to the DC bus voltage (430-440V). Voltage fed resonant inverters tend to be more efficient than current fed resonant inverters because voltage fed inverters utilize MOSFETS in a Zero Voltage Switching (ZVS) mode. In addition, the lamp current generated by voltage fed series resonant inverters is almost sinusoidal. It provides longer lamp life than a current fed inverter. Also, voltage fed series resonance inverters can be built without an output power transformer.

To take advantage of voltage fed inverters, multi-lamp ballasts sometimes are provided with several identical resonant tanks, each coupled to a single discharge lamp. For example, U.S. Pat. No. 7,372,215 issued to Sekine et al. discloses a multi-parallel lamp ballast with a single inverter and multiple resonant tanks. In addition to complexity, the above ballast needs to be restarted after replacing a lamp. It is provided with lamp out/in sensing to activate the restart. Patent Application 2007/0176564 issued to Nerone at al. discloses a multi-lamp application of a voltage fed self generated inverter having a regulated output voltage. This inverter is provided with output voltage clamping means since its control does not have enough resolution to limit this voltage at no load. Also, it has a number of multi-winding magnetic components which affect ballast cost.

One challenge in designing a multi-lamp series resonant ballast is to control both the wide range of load variations and the need for sufficient start up voltage. A few of such series resonant ballasts for powering multi-parallel lamps are known. For example, U.S. Pat. No. 6,362,575 issued to Chang et al. discloses a control circuit for a four lamp transformerless series resonance inverter with regulated output voltage. Four boost capacitors, each connected in series with a lamp, are used for ballasting gas discharge lamps. The ballast senses the number of lamps connected by monitoring the current via lamp filaments and generates reference voltages according to number of lamps connected to the ballast. The above approach requires additional wiring between the ballast and the lamps. U.S. Pat. No. 7,352,139 issued to Ribarich et al. discloses a static feedback control circuit for a multi-lamp series resonant inverter with a control IC utilizing a voltage control oscillator (VCO) for frequency control. Since VCO oscillations are not phase locked with resonant load oscillations, the VCO cannot follow changes in resonant load fast enough and may not always oscillate above the resonant frequency. According to the above patent application, the VCO integrates its input signal, causing a delay in dynamic frequency response. During transients in the resonant load (a gas discharge lamp may significantly change its resistance in few microseconds) or lamp removal, this delay can cause temporarily hard switching in the inverter MOSFETS and damage the inverter. ICs with adaptive ZVS (IR 2520D and other similar adaptive circuits) do not eliminate the cross conduction phenomena in switching transistors during unexpected transients in inverter load. U.S. Pat. No. 7,030,570 assigned to Osram Sylvania discloses a series resonant inverter single lamp operation in which hard switching is avoided during load transients.

Nevertheless, there is a need for a ballast control circuit and method aimed at multi-lamp instant start applications. Parallel connected lamps are preferable in multi-lamp series resonant ballast since the light in not interrupted when replacing lamps in a fixture. Existing control methods for multi-lamp inverters (0 load) are based on the concept that the resonant inverter voltage is regulated and ballasting of lamps is achieved with series capacitors. In one embodiment, the present invention provides a method and control circuit for parallel multi-lamp instant start operations that utilize the ballasting features of both resonant inverters and series capacitors.

SUMMARY OF THE INVENTION

In one embodiment, the present invention provides a series resonant ballast inverter for plurality of gas discharge lamps (up to 4 lamps typically) coupled in parallel. In another aspect, an embodiment of the invention provides a series resonant inverter for a variable number of lamps (typically from 1 lamp to 4 lamps) wherein lamp brightness is maintained almost independent of the number of lamps connected.

It is the other aspect of an embodiment of the present invention to provide a multi-parallel lamp series resonant inverter with dimming capability.

It is the other aspect of an embodiment of the present invention to provide a ballast control circuit having continuous no load operation with reduced power losses.

It is the other aspect of an embodiment of the present invention to provide multi-lamp ballast with ZVS inverter operation during transients.

It is the other aspect of an embodiment of the present invention to utilize a control IC (self oscillating half bridge driver) with minimum surrounding components.

It is the other aspect of an embodiment of the present invention to provide transformerless ballast for instant start lamps with limited leakage current satisfying electrical shock safety requirements.

It is a still another aspect of an embodiment of the invention to provide electronic ballast with minimum components, a simple schematic and a low cost.

In one embodiment, an electronic ballast comprises a series half bridge resonant inverter, a control circuit controlling the inverter switches, a first feedback circuit coupled between the inverter output and a control input and a second feedback circuit coupled between the inverter output and the control input.

In one embodiment, the electronic ballast comprises a series half bridge resonant inverter and a control circuit for the inverter with dimming capability. The inverter powers a number of gas discharge lamps connected in parallel via individual boost capacitors. The inverter includes a first and a second additional voltage feedback circuits via first and second charge pumps correspondingly coupled between the inverter output and the dimming input of the control circuit. The first charge pump generates a referenced control signal to achieve nominal lamp current/power after starting. The second charge pump generates an error control signal when the inverter output voltage exceeds a predetermined value. Both signals are summed at the dimming input of the inverter control circuit. The error control signal prevails during lamp starting, open circuit and reduced number of lamp operation modes. This error signal shifts the switching frequency higher to avoid voltage and current stresses in the inverter components. The referenced control signal prevails at full inverter load, shifting operation to a lower frequency and stabilizing the steady-state mode of the inverter. As a result, the inverter frequency changes as a function of number of lamps connected, and the inverter operates safely above the resonance frequency so that lamps are not overdriven.

BRIEF DESCRIPTION OF THE DRAWINGS

The invention is better understood with reference to the accompanying drawings in which.

DETAILED DESCRIPTION OF THE INVENTION

The present invention relates to a ballast control circuit with a self oscillating half bridge driver IC. Unlike other control circuits for half bridge resonant inverters having control ICs with a VCO, it utilizes direct feed-forward control from a resonant load that includes lamp resistance. A time duration of any half wave formed by the inverter depends on the lamp resistances during formation of the half wave. The inverter control circuit is described in Osram Sylvania U.S. Pat. No. 7,095,183 "Control System for Resonant Inverter with Self-Oscillating Driver". Accordingly, the inverter control system is provided with a source of regulated negative DC bias and a voltage feedback circuit as a source of positive DC bias. Both positive and negative DC bias currents are summed at the frequency control input of the resonant inverter. The negative DC bias current is applied to the frequency control input with a time delay relative to a beginning point of resonance inverter starting. The voltage feedback circuit converts the inverter output AC voltage to a DC voltage signal and compares this voltage signal to a reference signal. An error signal initiates the positive DC bias. A regulated negative DC bias current sets the nominal current and power of the lamps coupled to the inverter after starting. The positive DC bias current appears when the output voltage of resonant voltage reaches a given maximum level, which occurs during lamp starting or when one or more lamps are disconnected during ballast operation.

In one embodiment of the invention, two charge pump circuits are coupled to the inverter output. The first charge pump converts the AC inverter output voltage to a referenced negative DC bias signal. The second charge pump is used in a voltage feedback circuit for sensing an output AC voltage and converting sensed AC signal to a positive DC signal voltage. This positive DC signal voltage is compared with the referenced DC voltage and, if it exceeds this referenced voltage, an error signal is generated. The error signal is applied as a positive DC bias to the frequency control input for limiting inverter output voltage. The error signal may be amplified for more precise voltage limiting. A voltage feedback circuit limits the inverter output voltage in a no load mode as well as during lamp starting and during operation with a reduced number of lamps. Since the charge pumps are used in this feedback, all voltage control functions are provided relative to the inverter RMS output voltage.

Figure 1:
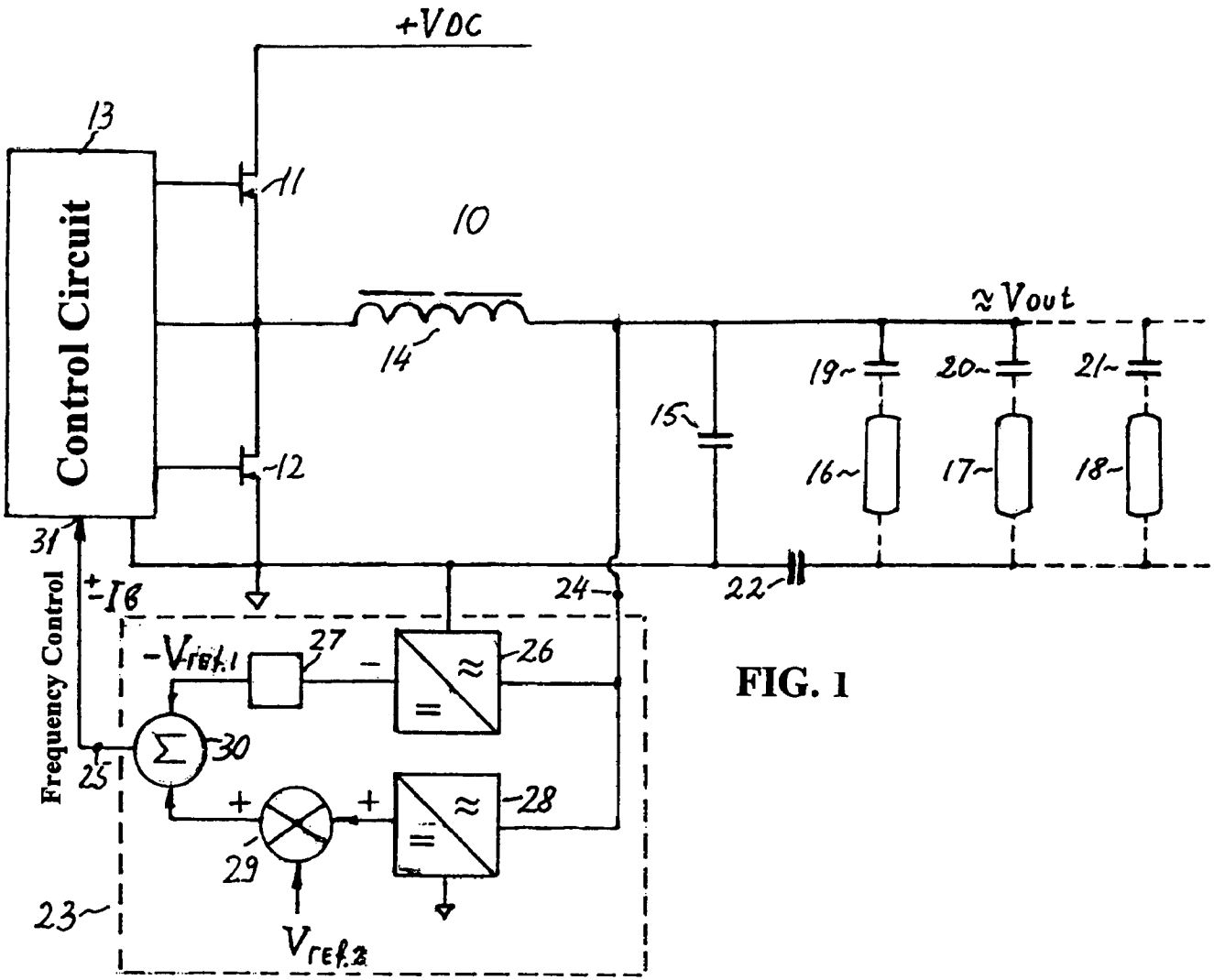
FIG. 1 is a circuit diagram of an instant start multi-lamp ballast inverter control circuit according to one embodiment of the invention.

FIG. 1 shows a block-circuit diagram for a multi-parallel lamps series resonant inverter 10 according to one embodiment of the invention. Practically, up to four gas discharge lamps can be connected in parallel to the output of the resonant inverter via individual boost capacitors. The ballast is provided with Power Factor Corrector (PFC) converting AC line voltage to regulated DC bus voltage VDC (PFC is not shown in FIG. 1). The input of a half bridge series resonant inverter 10 is coupled to regulated DC voltage bus (+VDC). The resonant inverter 10 converts the DC bus voltage to a high frequency AC voltage Vout. The power stages of inverter 10 include switching transistors 11 and 12 driven by a control circuit 13. The control circuit 13 incorporates high side and low side half bridge MOSFET drivers, an internal oscillator (not shown in FIG. 1), and a frequency control (not shown in FIG. 1). In general, any ballast inverter control circuit having frequency dimming capability may be used. For example, the circuit described in Osram Sylvania U.S. Pat. No. 7,095,183 may be used. Because it provides no time delay in changing the switching frequency when the ballast load changes, resonant inverters operate in a safe inductive mode during load transitions.

In FIG. 1, an inverter resonant tank comprises resonant inductor 14 and series resonant capacitor 15. Parallel gas discharge lamps 16, 17, and 18 are connected in series with boost capacitors 19, 20, and 21, all coupled in parallel to the inverter resonant tank 14, 15 via a DC blocking capacitor 22 separating the lamp terminals from the rest of inverter circuit. Boost capacitors 19, 20, 21 and DC blocking capacitor 22 limit low frequency lamp pin leakage current to ground in order to meet safety requirements. The resonant inverter includes a feedback control circuit 23 having its input terminal 24 coupled to inverter high voltage terminal Vout and an output terminal 25 coupled to a frequency control input 31 of the control circuit 13. The feedback control circuit 23 comprises a first AC/DC signal converter 26, and voltage regulator 27 at the output of converter 26 for providing a source of a first referenced negative voltage −Vref.1 for generating referenced negative bias current component. The feedback control circuit 23 comprises also a voltage negative feedback circuit limiting the output voltage Vout.

Circuit 23 includes a second AC/DC signal converter 28 for sensing inverter output voltage and converting this voltage to a positive DC signal voltage corresponding to the inverter output, and a voltage difference control circuit 29 for comparing the incoming DC voltage from the second AC/DC converter 28 to a second reference voltage Vref.2. The difference control circuit 29 generates a positive error signal and can employ an error amplifier (not shown in FIG. 1) for better regulation and stability of the inverter output voltage Vout. The error signal from the voltage difference circuit 29 provides a positive bias current component. Both positive and negative bias current components are summed by a summing circuit 30 and result in control bias current Ib applied to the frequency control input 31 of inverter control circuit 13. Bias control current Ib can be negative or positive depending on mode of inverter operation and load conditions. Signal converters 26 and 28 deliver output DC voltage signals that are proportional to inverter output voltage Vout.

Figure 1A:
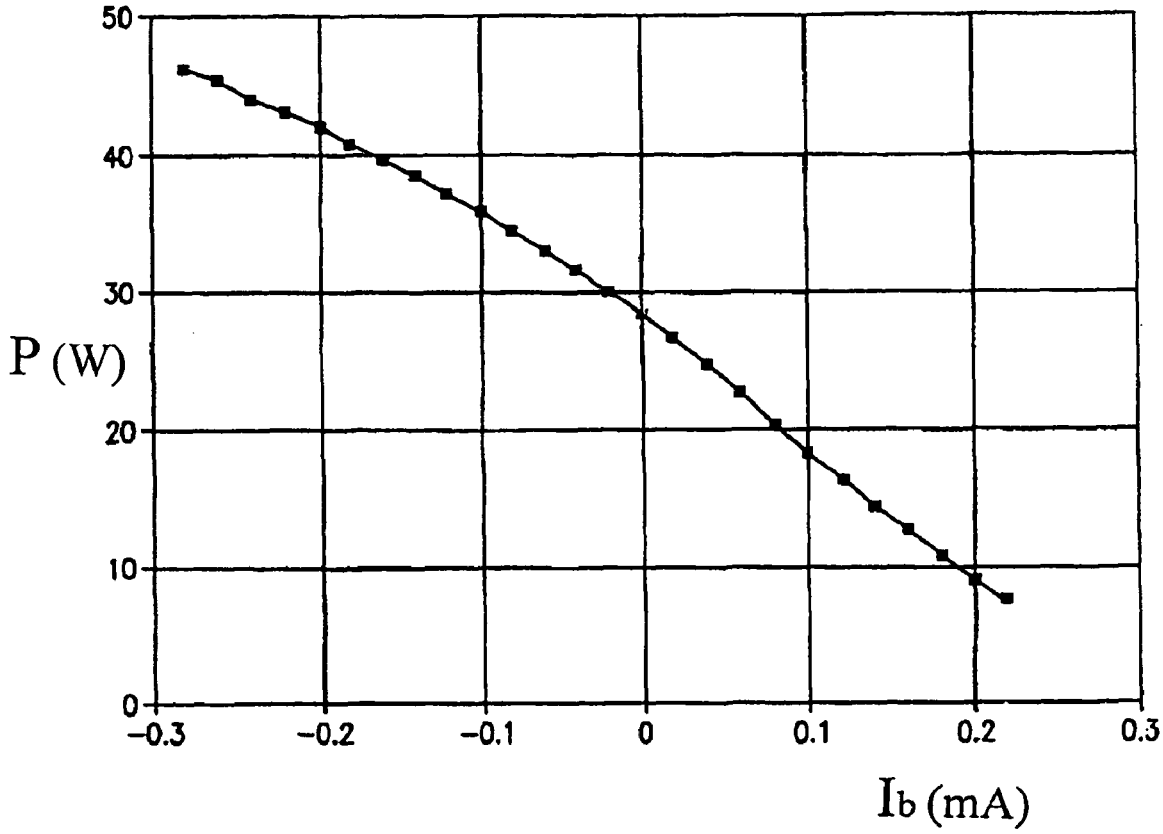
FIG. 1A illustrates a typical dimming characteristic (output power P versus DC control bias signal Ib) for the ballast inverter control circuit of FIG. 1.

FIG. 1A shows a typical output power P plot versus DC bias current Ib for the inverter in FIG. 1. Functional blocks of inverter in FIG. 1 are built accordingly to FIG. 1A plot to provide ballast functionality in various modes of operations.

Figure 2:
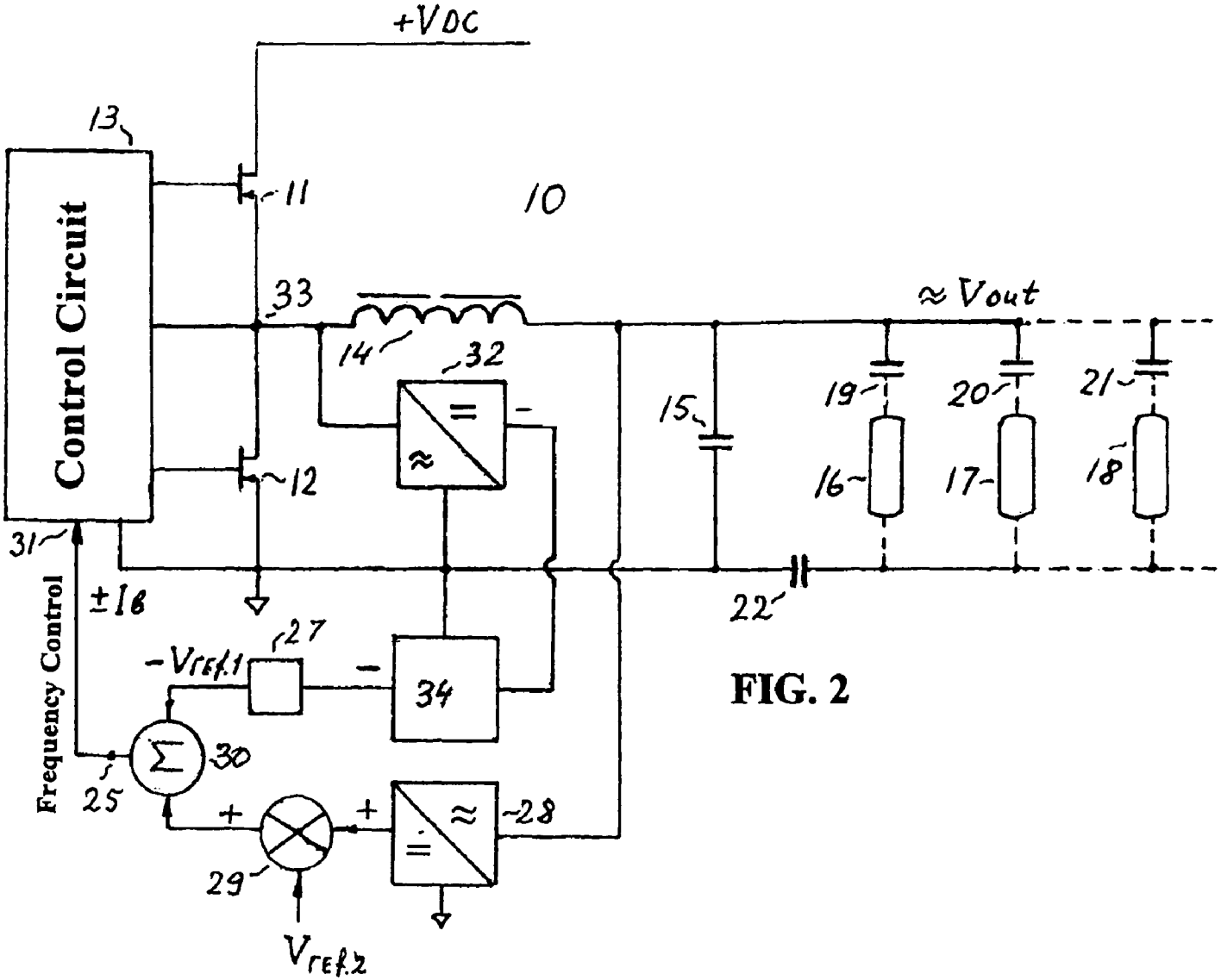
FIG. 2 is a circuit diagram of an instant start multi-lamp ballast inverter control circuit according to another embodiment of the invention.

FIG. 2 shows a diagram according to one embodiment of the invention having an AC/DC signal converter 32 as a negative bias current source coupled to common terminal 33 of the switching transistors 11 and 12. Output of the AC/DC converter 32 is connected in series with a time delay circuit 34. In both diagrams in FIG. 1 and FIG. 2, a negative bias signal appears with a delay after transistors 11 and 12 start switching. When starting the ballast, control circuit 13 initiates the switching of transistors 11 and 12 at a zero bias current Ib=0 with an initial frequency fo. The initial switching frequency fo of the control circuit 13 is set up (programmed) by an oscillating RC network (not shown in FIG. 1 and FIG. 2). It is understood that other sources of the AC signal (to which starting is correlated with inverter starting) may be used instead the AC/DC converter 32. Time delay means 34 may be a filtering circuit of the AC/DC converter 32.

When the voltage Vout appears at the inverter output, the control circuit 13 oscillations are automatically phase locked into resonant tank oscillations. The oscillator in control circuit 13 is automatically synchronized to the higher starting frequency fl>fo via a phase shifted voltage loop (this voltage loop is not shown in FIG. 1). The above loop provides phase advance for the feedback signal. For reliable synchronization at starting, frequency fl is selected 5-10% above the programmed frequency fo (synchronization via voltage feedback for a control circuit based on a self-oscillating driver IC is described in Osram Sylvania U.S. Pat. No. 7,095,183). AC/DC signal converters 26 and 28 both deliver output voltage signals proportional to the inverter output voltage Vout. The output negative voltage signal from the AC/DC signal converter 26 generates a negative component of bias current Ib that boosts the output voltage during lamp starting. The negative component of bias current Ib is limited by the voltage regulator 27. After starting the voltage regulator 27 provides a negative referenced voltage Vref.1, which in turns generates a negative referenced bias current that corresponds to nominal lamp power. During a starting mode or during reduced load conditions when the inverter voltage Vout is higher than its given maximum value, the output signal from signal converter 28 exceeds the Vref.2 voltage applied to voltage difference circuit 29. The bias current signal becomes positive and limits output voltage Vout. This maximum voltage value is selected such a way that it will allow continuous no load operation, from one side, and reliable all lamps starting, from the other side. Practically, for T8 lamps with instant start, this voltage is about 600-660V rms. Since this starting voltage has a frequency up to 30-40% higher than nominal operating frequency at full load, higher initial glow current in the lamps enhances rapid lamp starting.

Figure 3:
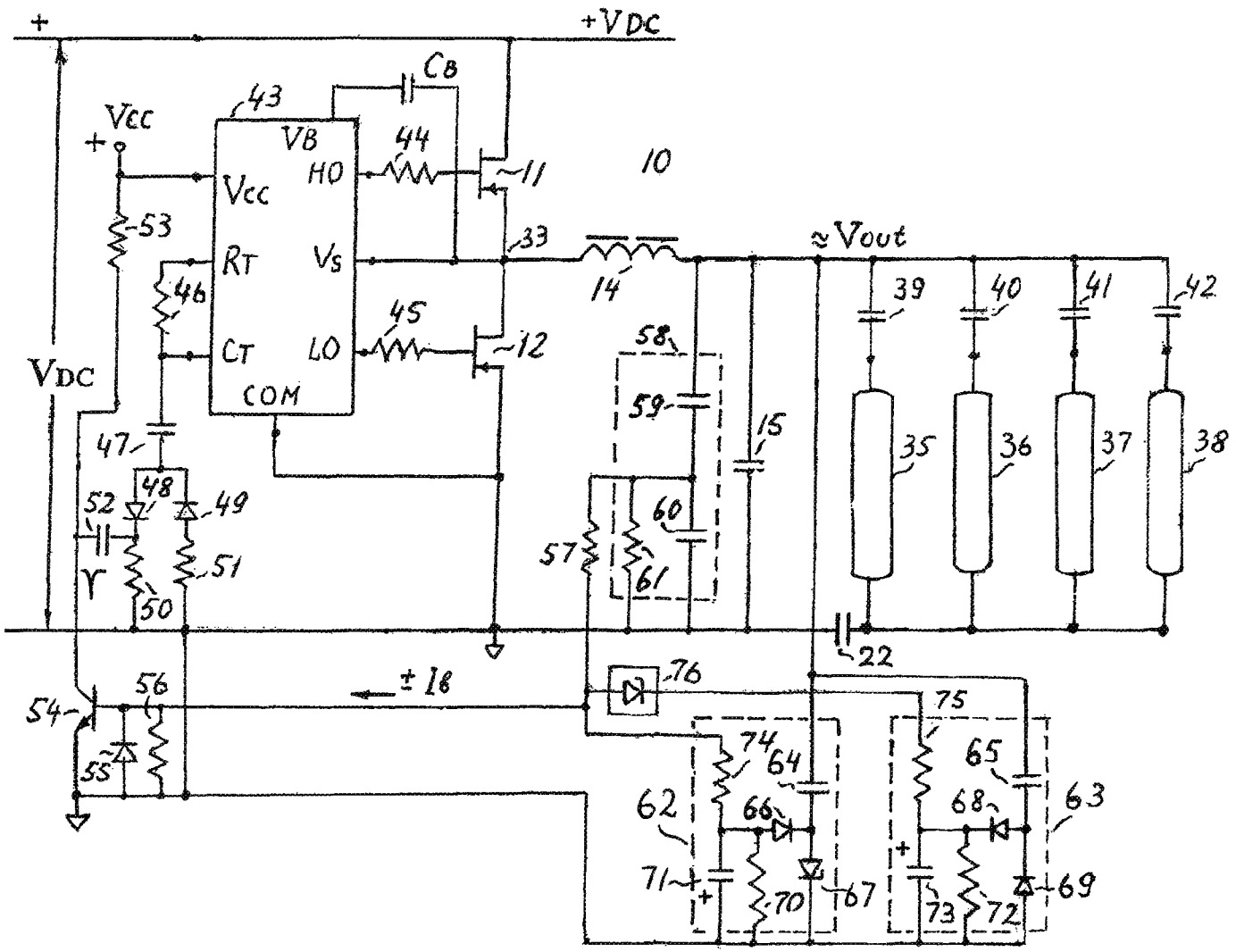
FIG. 3 is a circuit diagram of one embodiment of the invention.

FIG. 3 illustrates a schematic diagram of one embodiment of the invention corresponding to FIG. 1. The control circuit 13 in FIG. 1 corresponds to the above mentioned U.S. Pat. No. 7,095,183.

The circuit in FIG. 3 comprises the resonance inverter 10 powering discharge lamps 35, 36, 37, and 38 via boost capacitors 39, 40, 41, and 42, respectively. A standard self-oscillating driver IC 43 (for instance industry standard ST 6571) with surrounding circuitry provides a general synchronizing control arrangement with the resonant load. The driver IC 43 drives half bridge power stages with MOSFETs 11 and 12 via high HO and low LO outputs and gate resistors 44 and 45. The driver IC 43 is provided with a bootstrap capacitor CB connected between the pins VS and VB coupled to a bootstrap diode (not shown in FIG. 3). The driver IC 43 has a built in oscillator that is similar to the industry standard CMOS 555 timer. An initial oscillator frequency can be programmed with an external resistor 46 and a timing capacitor 47 coupled to pins CT and RT of the driver IC 43. In the driver IC 43, a low side output LO is in phase with the RT pin voltage signal. Since the RT pin voltage potential changes between low (0) and high (+Vcc) relative to common "com", the CT pin voltage VCT has a ramp shape superposed on a DC voltage. The IC 43 has a built-in oscillator which switches at high (⅔ Vcc) and low (⅓ Vcc) predetermined CT pin voltage levels. The timing circuit of the IC 43 corresponds to U.S. Pat. No. 7,095,183 by inserting between the common terminal "com" and the timing capacitor 47 (see FIG. 3) a network comprising two anti-parallel diodes 48 and 49 and resistors 50 and 51 coupled to the "com" terminal. A small capacitor 52 (100-200 pf) is connected between the common point of the diode 48 and the resistor 50 and +Vcc terminal via a resistor 53. The common point of the capacitor 52 and the resistor 53 is connected to the collector of a small signal transistor 54 used as a zero signal detector. The transistor 54 input comprises an anti-parallel diode 55 and a noise suppressing resistor 56. The transistor 54 switches when its input signal changes polarity. It will initiate an instant discharge of capacitor 52 via the resistor 50 when the input sinusoidal signal changes from negative to positive.

As a result, negative strobe pulses will be generated across resistor 50. The strobe pulses will be injected in the RC timing and superposed on the CT pin ramp voltage causing a forced switching of the IC 43. The input sinusoidal current signal to the switching transistor 54 is provided via resistor 57 from a phase compensator 58 that senses the inverter output voltage Vout. The phase compensator 58 provides attenuation and a phase advance (delay) for a feedback signal that is necessary to synchronize the controller at the desirable frequency above resonant. The phase advance compensator 58 in FIG. 3 includes series capacitors 59 and 60 and a resistor 61 connected in parallel to the capacitor 60. The advance phase of the feedback signal and the synchronization frequency can be adjusted, for instance, by resistor 61 variations.

For variable load applications such as ballasts driving multiple instant start lamps with a hot lamp swap feature, two charge pumps 62 and 63 are utilized to act as AC/DC signal converters 26 and 28 (shown in block diagram of FIG. 1). The first charge pump 62 corresponds the first AC/DC signal converter 26 that generates a negative control signal and the second charge pump 63 corresponds the second AC/DC signal converter 28 that generates a positive control signal. Both charge pumps 62 and 63 are connected to the inverter output Vout via series capacitors 64 and 65, respectively. The first charge pump 64 comprises a negative output signal rectifier with diodes 66 and 67. The second charge 66 pump comprises a positive output signal rectifier with diodes 68 and 69. The first charge pump 62 is preloaded with a first resistor 70 and a first smoothing capacitor 71. The second charge pump 63 is preloaded with a second resistor 72 and a second smoothing capacitor 73. A Zener type diode 67 may be used in the charge pump 62 for generating referenced negative DC control signal (see Vref.2 in FIG. 1) at the output of charge pump 62. Both charge pumps 62 and 63 are provided with series resistors 74 and 75 for generating DC bias control signals for dimming.

A Zener diode 76 is connected between charge pump 63 and the base of transistor 56. The Zener diode 76 is used as a source of reference voltage (see Vref.1 in FIG. 1) in the static feedback loop for limiting the output inverter voltage Vout. DC signals from charge pumps 62 and 63 are summed at the base of the transistor 54. The resulting DC bias control signal Ib can be negative or positive during different modes of ballast operation. Since the charge pumps include series capacitors, they generate an output voltage signal proportional to the inverter voltage Vout and its frequency. The resistor 75 compensates for increases in feedback loop gain caused by the series capacitor 65 when the inverter frequency increases. When limiting output voltage Vout, the Zener diode 76 conducts and its current is higher than referenced negative DC signal from the charge pump 62. The total DC bias current Ib becomes positive and causes the inverter frequency to increase limiting the rms output voltage Vout. Zener diode 76 is selected to start conducting at a desirable open circuit voltage Vout max. This open voltage should be high enough for reliable lamp starting and should not overstress components or cause significant power loss when the ballast is operating in an open circuit mode.

Figure 4:
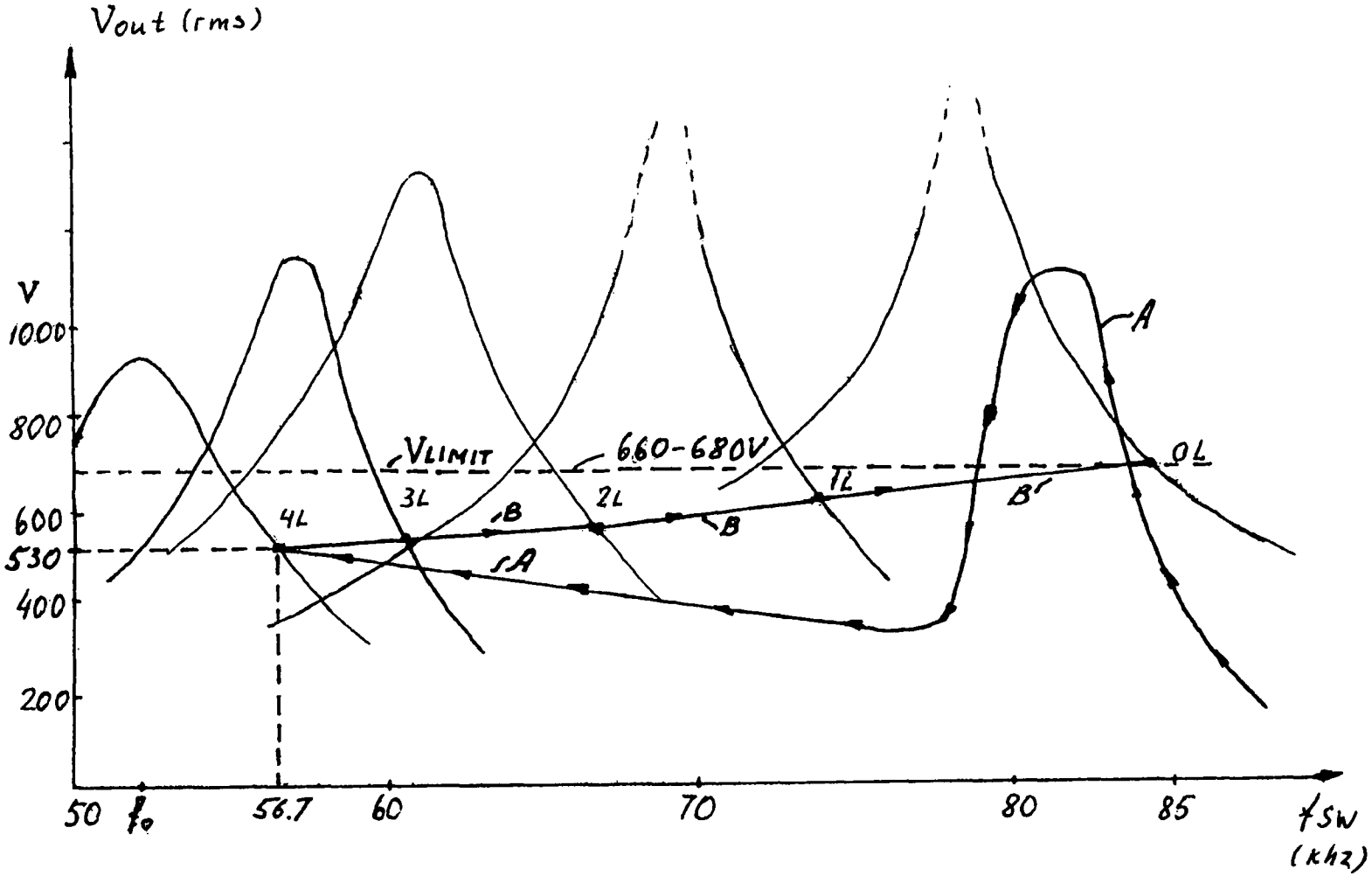
FIG. 4 is (a prior art diagram) illustrating a family of conventional resonant plots of inverter output voltage Vout versus switching frequency when driving different numbers of lamps.

FIG. 4 demonstrates a family of inverter output voltages Vout versus switching frequency fsw plots for the resonant inverter illustrated in FIG. 3. In particular, FIG. 4 illustrates an inverter built with a resonant inductor 14 having inductance Lr=1.67 mH, a resonant capacitor 15 having a capacitance Cr=2.2 nF, a DC capacitor 22 having a capacitance 0.1 uF, and series capacitors 39-42 each having a capacitance 1 nF. The MOSFET half bridge was driven by a standard L6571A self oscillating IC having initial oscillator frequency fo=52-54 kHz. The regulated DC bus voltage VDC=430V is provided by a Power Factor Corrector (not shown in FIG. 3). The plots in FIG. 4 correspond to conventional resistive loads that are equivalent to the nominal steady-state resistance of lamps. Points 0L, 1L, 2L, 3L and 4L designate inverter steady-state operation points corresponding to the number of lamps connected. For instance, point 4L shows the nominal operating mode with 4 lamps featuring fsw=56.7 kHz and Vout=530V. A dotted horizontal line designate level of limiting output voltage Vout=VLIMIT in steady-state no lamps operation.

Figure 5:
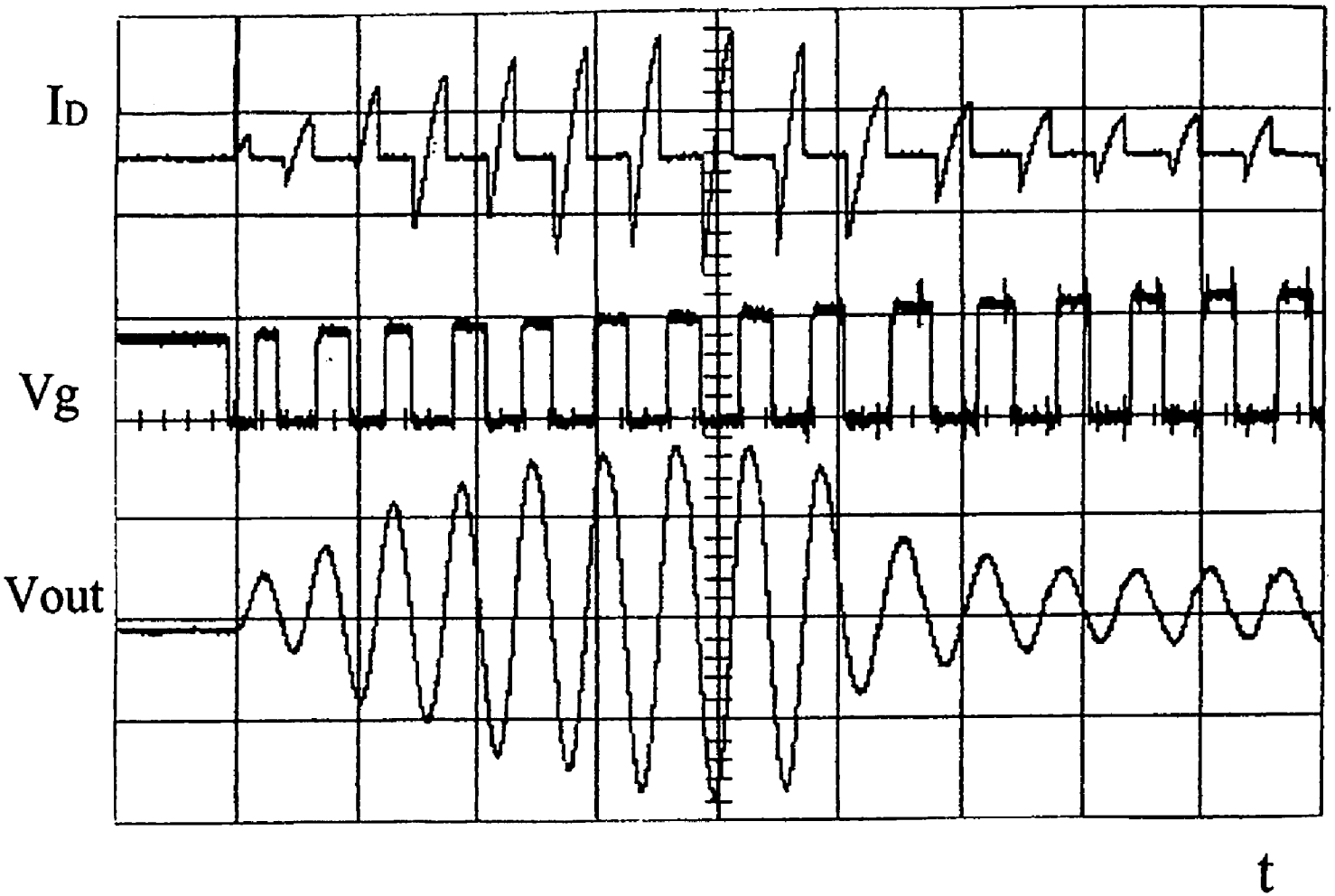
FIG. 5 illustrates an inverter transistor current and output inverter voltage during starting with four lamps according to one embodiment of the invention.

Further, in FIG. 4, a starting trajectory A of the inverter of FIG. 3 with four T8 32 W lamps is shown. In FIG. 5, a corresponding diagram of transistor 11 drain current ID, transistor 12 gate voltage Vg and inverter output voltage Vout over time are shown. The inverter IC 43 (FIG. 3) locks to the inverter resonant tank oscillations with the first energizing pulse provided by the upper transistor 11. During the first cycles, the inverter operates to open circuit the oscillator, which is synchronized to the initial switching frequency, which may be twice as high as its nominal frequency (see trajectory A starting). Then, the output voltage Vout increases rapidly. Since the negative voltage feedback circuit comprising the charge pump 63 has a built in time delay, some overshunt voltage (the voltage that is above selected VLIMIT) has been generated during the first 3-4 cycles. The overshunt voltage provides a rapid gas braking simultaneously in all parallel lamps.

Further, in FIG. 4, a trajectory B is shown designating inverter operation when the lamps are sequentially disconnected from inverter output.

In FIG. 4, a preferable mode of operation with varying numbers of lamps (four lamps L4, three lamps L3, two lamps L2 and one lamp L1) is demonstrated. Except for a no lamp mode, the resonant inverter generates output voltages Vout that are below VLIMIT. A trajectory B shows the inverter operation when the lamps are sequentially disconnected from the inverter output. By this approach, the ballasting characteristics of the resonant inverter are utilized, as well as the ballasting provided by impedance of series capacitors 39-42. This is in contrast to prior art resonant inverters having regulated output voltage and ballasting provided only by series capacitors.

In one embodiment, a series resonant inverter to continuously operate in an open circuit is provided. In this open circuit mode, a total power loss in the inverter is about the same as at full inverter load.

One advantage of the multi-lamp series resonant ballast of one embodiment of the invention is that in steady-state and transient modes of operation its inverter operates above resonance (the inverter resonant load including lamps is inductive).

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the invention are achieved and other advantageous results attained.

Having described aspects of the invention in detail, it will be apparent that modifications and variations are possible without departing from the scope of aspects of the invention as defined in the appended claims. As various changes may be made in the above constructions, products, and methods without departing from the scope of aspects of the invention, it is intended that all matter contained in the above description and shown in the accompanying drawings shall be interpreted as illustrative and not in a limiting sense.

The invention claimed is:

1. An electronic ballast comprising:

a series half bridge resonant inverter including switches having an output for powering a plurality of gas discharge lamps connected in parallel;

a control circuit controlling the inverter switches and having a control input, the control circuit responsive to signals provided to the control input to vary a switching frequency of the inverter switches;

a first feedback circuit coupled between the inverter output and the control input, said first feedback circuit generating a referenced control signal provided to the control input to adjust the switching frequency of the inverter switches so that the inverter output provides a substantially constant current to power the plurality of lamps after starting; and a second feedback circuit coupled between the inverter output and the control input, said second feedback circuit generating an error control signal provided to the control input to adjust the switching frequency of the inverter switches when the output voltage exceeds a predetermined value.

2. The ballast of claim 1 wherein the referenced control signal and the error control signal are summed and applied to the control input of the control circuit.

3. The ballast of claim 1 wherein the second feedback circuit provides an error control signal to the controller which causes the controller to reduce the inverter current by increasing the inverter frequency when a lamp is removed whereby the inverter switches operate above a resonance frequency of the lamps so that the power applied to the lamps does not overdrive the lamps.

4. The ballast of claim 1 wherein the control circuit has a dimming capability controlled by a dimming input to the control circuit and wherein the feedback circuits are coupled between the inverter output and the dimming input of the control circuit.

5. The ballast of claim 1 wherein the first feedback circuit comprises an AC/DC signal converter connected to the inverter output and a voltage regulator connected to an output of the AC/DC signal converter for providing a referenced negative voltage applied to the control input.

6. The ballast of claim 5 wherein the signal converter comprises a charge pump comprising a negative output signal rectifier.

7. The ballast of claim 5 wherein the second feedback circuit comprises another AC/DC signal converter connected to the inverter output and providing a positive DC signal voltage corresponding to the inverter output and a voltage difference control circuit for comparing the positive DC signal voltage to a reference, wherein the voltage difference control circuit provides a positive error signal applied to the control input.

8. The ballast of claim 7 wherein the signal converters provide output voltage signals proportional to the inverter output AC voltage.

9. The ballast of claim 1 wherein the second feedback circuit comprises an AC/DC signal converter connected to the inverter output and providing a positive DC signal voltage corresponding to the inverter output AC voltage and a voltage difference control circuit for comparing the positive DC signal voltage to a reference, wherein the voltage difference control circuit provides a positive error signal applied to the control input.

10. The ballast of claim 9 wherein the signal converter comprises a charge pump comprising a positive output signal rectifier.

11. The ballast of claim 1 wherein the first feedback circuit comprises a negative bias current source coupled to a common terminal of the inverter switches having an output connected to a time delay circuit having an output connected to a voltage regulator for providing a referenced negative voltage applied to the control input.

12. The ballast of claim 1 wherein the first feedback circuit comprises a first charge pump generating a referenced control signal to achieve nominal lamp current/power after starting and wherein the second feedback circuit comprises a second charge pump generating an error control signal when the inverter output voltage exceeds a predetermined value.

13. The ballast of claim 12 wherein the error control signal prevails during lamp starting, when the inverter output is open circuited and when a reduced number of plurality of lamps are connected to the inverter output.

14. The ballast of claim 12 wherein the referenced control signal prevails when the plurality of lamps are connected to the inverter output thereby lowering the switching frequency lower and stabilizing steady-state mode of the inverter.

15. An electronic ballast comprising:

a series half bridge resonant inverter including switches having an output for powering a plurality of gas discharge lamps connected in parallel;

a control circuit controlling the inverter switches and having a dimming control input, the control circuit responsive to signals provided to the dimming control input to vary a switching frequency of the inverter switches;

a first feedback circuit including a first charge pump coupled between the inverter output and the dimming control input, said first feedback circuit generating a referenced control signal to adjust the switching frequency of the inverter switches so that the inverter output provides a substantially constant current to power the plurality of lamps after starting;

a second feedback circuit including a second charge pump coupled between the inverter output and the dimming control input, said second feedback circuit generating an error control signal to adjust the switching frequency of the inverter switches when the output voltage exceeds a predetermined value;

wherein the referenced control signal and the error control signal are summed and provided to the dimming control input.

16. The ballast of claim 15 wherein the first feedback circuit comprises a first charge pump generating a referenced control signal to achieve nominal lamp current/power after starting and wherein the second feedback circuit comprises a second charge pump generating an error control signal when the inverter output voltage exceeds a predetermined value.

17. The ballast of claim 16 wherein the error control signal prevails during lamp starting, when the inverter output is open circuited and when a reduced number of plurality of lamps are connected to the inverter output.

18. The ballast of claim 16 wherein the referenced control signal prevails when the plurality of lamps are connected to the inverter output thereby lowering the switching frequency lower and stabilizing steady-state mode of the inverter.

* * * * *